United States Patent [19]

Sexstone et al.

[11] Patent Number: 4,636,183

[45] Date of Patent: Jan. 13, 1987

[54] APPARATUS FOR MAKING GROOVES IN CIGARETTE FILTERS

[75] Inventors: John H. Sexstone, Anchorage; Everett N. Finn, Louisville; Byron L. Lowe, Prospect; Ken M. Milliner, Louisville, all of Ky.

[73] Assignee: Brown & Williamson Tobacco Corporation, Louisville, Ky.

[21] Appl. No.: 639,759

[22] Filed: Aug. 13, 1984

Related U.S. Application Data

[62] Division of Ser. No. 464,277, Feb. 7, 1983, Pat. No. 4,480,982.

[51] Int. Cl.[4] ..... A24D 3/02; B31C 13/00

[52] U.S. Cl. ..... 493/42; 493/43

[58] Field of Search ..... 131/94, 95

[56] References Cited

U.S. PATENT DOCUMENTS 4,149,546 4/1979 Luke et al. ..... 131/94

*Primary Examiner*—V. Millin

*Attorney, Agent, or Firm*—Charles G. Lamb

[57] ABSTRACT

An apparatus for, in one advantageous embodiment, concurrently forming a plurality of generally longitudinally extending grooves in a filter rod, and in another advantageous embodiment, for making small apertures in the grooves as the grooves are being formed in the filter rod. The apparatus includes a reciprocating die having an upper die block and a lower die block. Each die block includes protruding, elongated projections which are adapted to be imbedded into the filter rod upon closing of the die to impress grooves in the filter rod located in the die. In the embodiment wherein apertures are to be formed in the grooves, aperture forming punches are associated with each of the groove forming projections for punching apertures in the grooves as they are being formed. The apparatus further includes a hopper for storing a plurality of filter rods to be grooved, a dispenser device for receiving ungrooved filter rods from the hopper and distributing the ungrooved filter rods in a proper orientation to the die, a feed guide device for transferring the ungrooved filter rods in an aligned manner from the dispenser device to the die, and an exit guide device downstream of the die for transferring grooved filter rods away from the die in an orderly manner so as not to cause a jam.

12 Claims, 10 Drawing Figures

APPARATUS FOR MAKING GROOVES IN CIGARETTE FILTERS

This is a division of Application Ser. No. 464,277, filed Feb. 7, 1983, now U.S. Pat. No. 4,480,982.

BACKGROUND OF THE INVENTION

1. Field of the Invention

The present invention relates to the manufacture of filters for cigarettes and more particularly to the making of grooves in a cigarette filter. Even more particularly, the present invention relates to a method and apparatus for forming grooves in a filter rod and apertures in the grooves at preselected locations.

2. Description of the Prior Art

Cigarettes are often provided with filter devices at one end to remove selected materials from the smoke stream coming from the tobacco column during smoking. These filters, which are attached to the tobacco column, come in many different sizes, shapes and forms. Some filters which are presently on the market include grooves. In some filter constructions the grooves facilitate the by-passing of smoke around the filter. In other filter constructions the grooves provide a channel for mixing ventilating air and by-passed smoke. In still other constructions the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radially reciprocating pins that periodically move into and out of the longitudinal path of a filter rod as the filter rod tow moves past. When the pins extend into the path of the tow they impress grooves in the filter rod. U.S. Pat. No. 4,149,546 shows an apparatus for making grooves in a cigarette filter wherein a filter rod is moved in an arcuate path transverse to a heated groove forming means, the filter rod being supported and conveyed for relative movement at the periphery of a drum-shaped inner rotor and the groove forming means compresses a heated arcuate outer stator element or elements projecting inwardly toward the rotor. U.S. Pat. No. 4,324,540 teaches an apparatus for making grooves in filters which includes a plurality of fixed position groove forming blades and a filter plug conveying device located next to the groove forming blades. Cigarette filters to be grooved are moved along a path between the conveyor device and blades, rolling past the blades whereupon grooves are formed in the filters by the blades.

SUMMARY OF THE INVENTION

It is an object of the present invention to provide an apparatus for making grooves in cigarette filter rods. It is a further object of the present inventor to provide an apparatus for making grooves in cigarette filter rods and small apertures in the grooves.

More particularly, the present inventor provides an apparatus for making grooves in a filter rod comprising die means comprising a lower die block adapted for vertical movement and having groove forming projections as its upwardly facing surface, an upper die block adapted for vertical movement and having groove forming projections at its downwardly facing surface, the downwardly facing surface of the upper die block being disposed in overlaying facing relationship to the upwardly facing die block, whereby the groove forming projections of the lower die block and upper die block are adapted to be imbedded into a filter rod disposed between the lower and upper die blocks to impress grooves in the filter rod when the lower and upper die blocks are vertically moves toward each other, means for moving the upper and lower die blocks vertically toward each other in unison, and stripper means for holding the grooved filter rods stationary as the lower as the upper and lower die blocks move away from each other to allow the groove forming projections of the lower and upper die blocks to be extracted from the filter rod.

BRIEF DESCRIPTION OF THE DRAWINGS

A more complete understanding of the present invention will be obtained upon reference to the following description in conjunction with the accompanying drawings wherein.

DESCRIPTION OF THE PREFERRED EMBODIMENT

Figure 1:
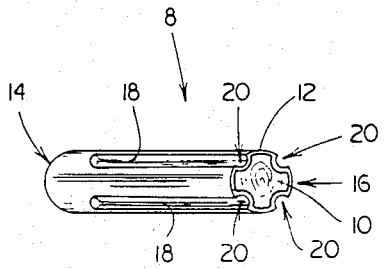
FIG. 1 is perspective view of a representative filter rod capable of being manufactured by the apparatus of the present invention.
Figure 2:
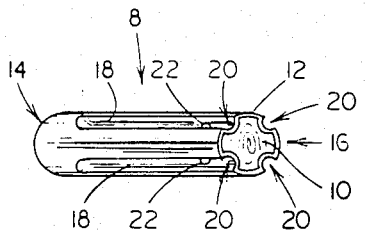
FIG. 2 is a perspective view of another representative filter rod capable of being manufactured by the apparatus of the present invention.
Figure 3:
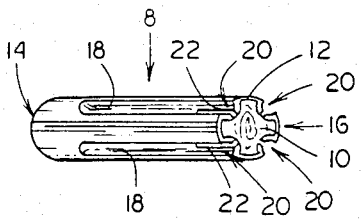
FIG. 3 is a perspective view of yet another representative filter rod capable of being manufactured by the apparatus of the present invention.

Novel cigarette filters 8 of the types depicted in FIGS. 1–3 comprise a generally cylindrical shaped filter core 10 fabricated of an air and smoke permeable material and a circumscribing wrapper 12 fabricated of an air and smoke impermeable material. The wrapper 12 extends longitudinally of the filter core 10 from one end 14 of the filter core 10 to the other end 16 thereof so that the filter core ends 14 and 16 are in mutual flow-through relationship. A plurality of grooves 18 are formed in the wrapper 12 and embedded into the filter core 10. Each of the grooves 18 is open, as designated by the number 20, at the mouth end 16 of the filter core 10 and extends therefrom in a generally longitudinal direction of the filter core 10 for a distance less than the length of the filter core 10. The grooves 18 are illustrated as being four in number, and are equally spaced from each other about the circumference of the filter core 10.

The embodiment shown in FIG. 2 also includes small apertures 22 formed through the thickness of the embedded portion of the wrapper 12 defining the grooves 18. As shown, one aperture 22 is formed in each groove 18 adjacent to the mouth end 16 of the filter core 10, however, it is known to form more than one aperture 22 in each groove 18.

The embodiment of FIG. 3 illustrates the filter core 10 having an elongated slit type aperture 22 formed through the thickness of the wrapper 12 defining each of the grooves 18. The slit type apertures 22 extend longitudinally of the groove 18 from the mouth end 16 of the filter core 10 a distance less than the length of the groove 18.

The filter 8 is attached to a tobacco column (not shown) by means of a permeable tipping material (not shown) which circumscribes the filter 8 and overlaps a portion of the tobacco column in a manner known in the art to form a filtered cigarette.

Figure 4:
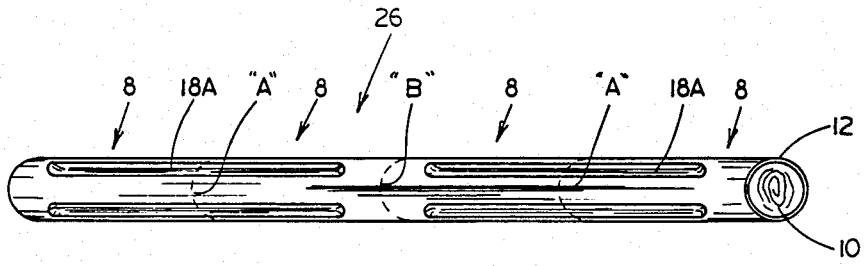
FIG. 4 is a perspective view of a filter rod tow from which the representative filters on FIGS. 1–3 are made.

With reference to FIG. 4, as a manufacturing expedient, individual filters 8 are manufactured from a filter material. A filter rod 26 of generally cylindrical shape is as long as a preselected number of filters 8. The filter rod 26 is formed with longitudinally extending grooves 18A each of which is twice as long as a groove 18 in the filter 8. The double length grooves 18A are arranged in groups of grooves, the groups being spaced apart longitudinally of the filter rod 26. Each group of dounle length grooves 18A consists of from three to seven grooved circumferentially, equally spaced apart about the perimeter of the filter rod 26. Further, in the manufacture of filters 8 incorporating the small aperture 22 in the grooves 18, as depicted in FIG. 2, each double length groove 18A is formed with twice the number of apertures 22 as in each groove 18 of the finished filter 8 arranged symetrically to each side of the transverse centerline of the double length groove 18A in which they are formed.

Similarly, in the manufacture of filter 8 incorporating elongated slit type apertures in the grooves 18, as depicted in FIG. 3, each double length groove 18A is formed with an aperture which is twice as long as a slit type aperture 22 in a groove 18 of the finished filter 8 and arranged symetrically to each side of the transverse centerline of the double length groove 18A. The filter rod 26 is severed generally transversely to the longitude of the filter rod 26 at intervals, corresponding to the desired filter 8 length, into individual filters 8. As can be visualized by reference to FIG. 4, the filter rod 26 is severed at locations, denoted by the dashed line "A", at the transverse centerline of the double length grooves 18A and at locations, denoted by the dashed line "B" generally halfway between adjacent groups of double length grooves 18A.

FIGS. 5 through 9 show an apparatus, generally denoted as the numeral 28, for making the grooves 18 and apertures 22 in the filters 8 of FIGS. 1 through 3. For the reasons mentioned above, and as a further manufacturing expedient, the apparatus 28 is adapted to form double length grooves 18A and apertures 22 in a plurality of filter rods 26 at one time in order to obtain a high rate of production. Therefore, the following discussion will speak to forming grooves 18A in the filter rods 26, but it should be clearly understood that the apparatus 28 could be just as readily be used to form grooves 18 in individual filters 8 essentially without modification.

The apparatus 28 of FIGS. 5 through 9 generally comprises groove forming means 30 for forming the grooves 18A, hopper means 32 for storing a plurality of filter rods 26 to be grooved, dispenser means 34 for receiving ungrooved filter rods 26 from the hopper means 32 and orienting the filter rods 26 for proper feeding of the ungrooved filter rods 26 to the groove forming means 30, feed guide means 36 for transferring the ungrooved filter rods 26 in an aligned manner from the dispenser means 34 to the groove forming means 30, and exit guide means 38 downstream of the groove forming means 30 for transferring grooved filter rods 26 away from the groove forming means 30 in an orderly manner so as to diminish the chances of a jam of grooved filter rods 26 at the exit of the groove forming means 30 which could interrupt the continuous production process.

Figure 5:
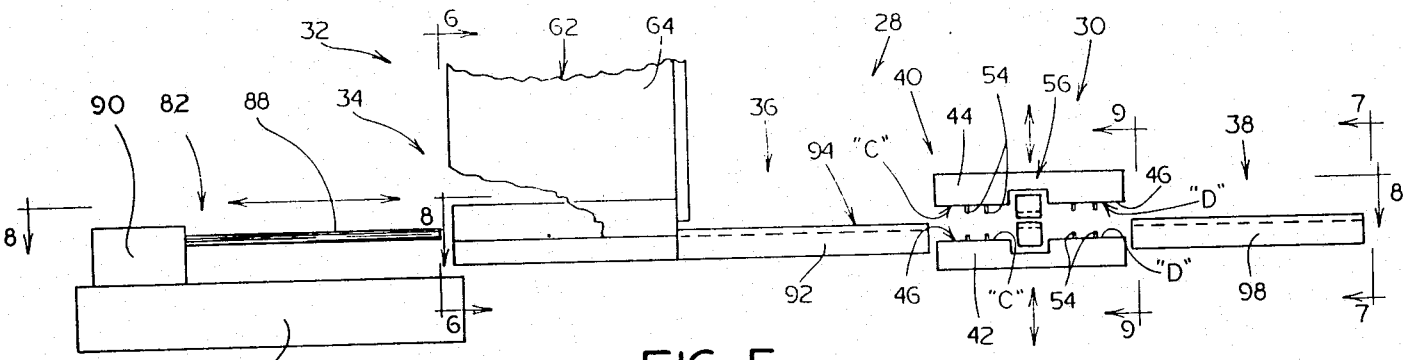
FIG. 5 is a side view of the apparatus for making grooves in filter rods and filter rod tows embodying the features of the present invention.
Figure 8:
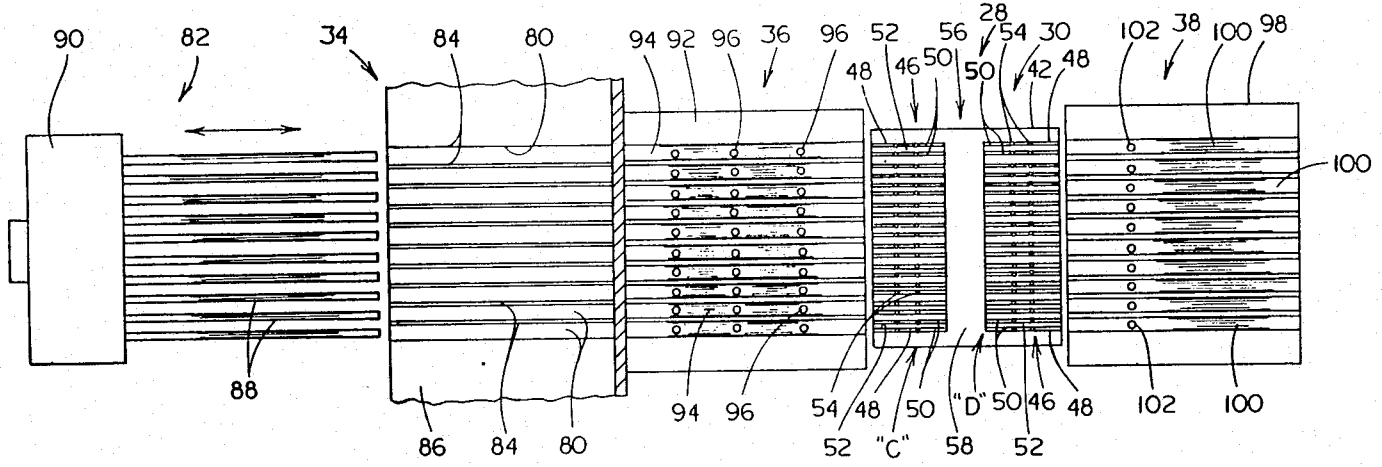
FIG. 8 is a top view of a portion of the apparatus of FIG. 5 as viewed in the direction of arrows 8—8 in FIG. 5.
Figure 9:
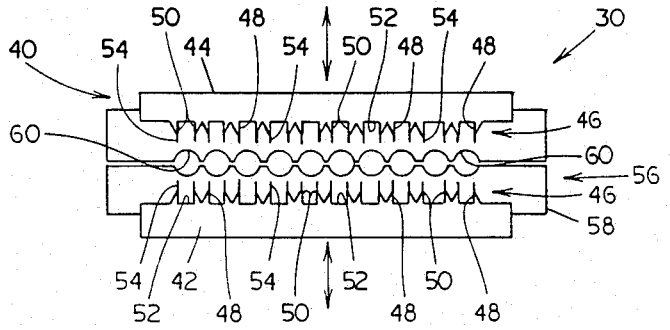
FIG. 9 is an end view of a portion of the apparatus of FIG. 5 as viewed in the direction of arrows 9—9 in FIG. 5; and, FIG. 10 is an enlarged view of a drive system for moving various components of the apparatus of FIG. 5.1

As can be best seen in FIGS. 5, 8 and 9, the groove forming means 30 comprises a reciprocating die 40 having a vertically movable lower die block 42 and a vertically movable upper die block 44 overlaying and in facing alignment with the lower die block 42. The lower and upper die blocks 42 and 44, respectively, are mounted for coordinated movement toward and away from each other as indicated by the double headed arrows. The lower and upper die blocks 42 and 44 are essentially identical and, therefore, for the sake of simplicity and clarity of discussion only the bottom die block 42 will be hereinafter described in detail, it being fully understood that the discussion applies equally to the upper die block 44 as well. Toward this end, the numerals denoting components and features common to both the lower and upper die blocks are the same in the illustrations of the lower die block 42 and upper die block 44. As can be best seen in FIG. 9, the die block 42 comprises groove forming groove impressing means 46 at the working face of the die block 42 for impressing the double length 18A in the filter rods 26 when the upper and lower die blocks are moved toward each other. The groove impressing means 46 are shown as including a plurality of elongated, spaced apart, generally parallel projections 48 jutting from the face of the die block. The groove forming projections 48 are spacially grouped in pairs, generally denoted as the numeral 50, across the width of the die block 42 with the space between the projections 48 of each pair being less than the diameter of a filter rod 26. As illustrated, it has been found practical to form the projections 48 by making elongated, parallel, spaced apart channels 52 in the working face of the die block 42 such that the longitudinal edges of the channels 52 define parallel rows of groove forming projections 48. As a manufacturing expedient, the die block 42 is formed with longitudinally aligned, spaced apart ranks, denoted by the letters "C" and "D", of rows of groove forming projections 48 with each pair 50 of groove forming projections 48 of one rank "C" being in longitudinal alignment with a different one of the pairs 50 of groove forming projections 48 of the other rank "D". The lower and upper die blocks are oriented in aligned facing relationship such that each pair 50 of groove forming projections 48 of the lower die block 42 is in alignment with a different one of the pairs 50 of groove forming projections 48 of the upper die block 44.

Figure 10:
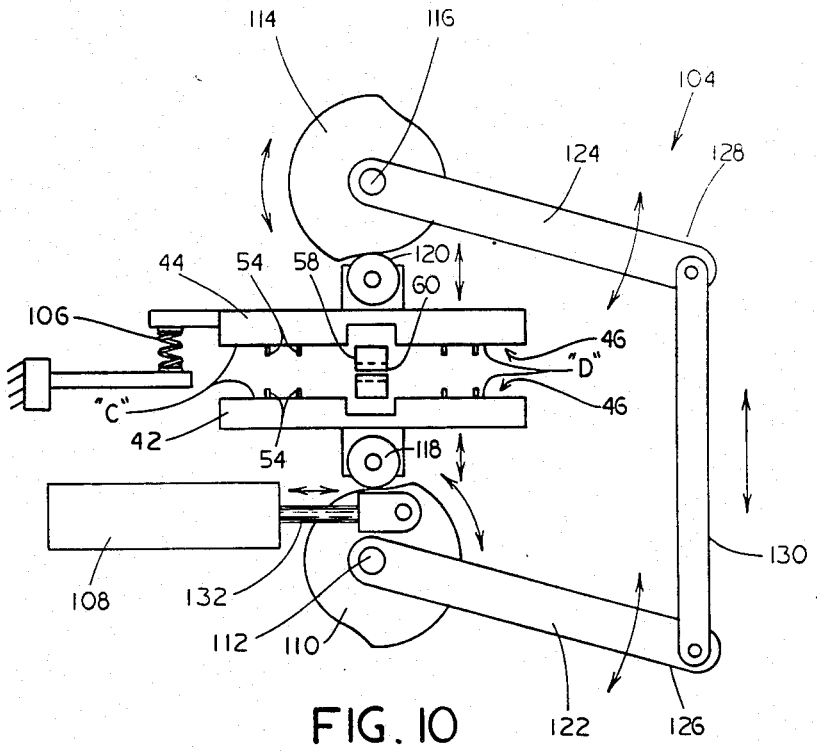

For manufacturing filters 8 having apertures 22 in the grooves 18, the die blocks 42 and 44 further include aperture forming means for making the aperture 22 in the double length grooves 18A of the filter rod 26. As shown, the aperture forming means include small punches 54 mounted along the groove forming projections 48 and projecting outwardly therefrom at generally a right angle to the working face of the die block. The number, shape and size of the punches 54 is dictated by the number, shape and size of the apertures 22 to be formed in the grooves 18A of the filter rod 26. Likewise, the position of the punches 54 along the groove forming projections 48 is dictated by the position of the apertures 22, along the grooves 18 of the filter 8 from the mouth end of the filter. As can be best understood by reference to FIGS. 5 and 8, the number of punches 54 along each groove forming projections 48 are equally divided and symetrically arranged to each side of the transverse centerline of the groove forming projection. The position of the punches 54 relative to the transverse centerline of each groove forming projection 48 corresponds to the position of the apertures 22 to be formed in each groove 18 of an individual filter 8 relative to the mouth end 16 of the filter 8. FIGS. 8 and 10 illustrates two punches 54 at each groove forming projections 48 equally spaced to either side of the transverse centerline of the groove forming projections 48 so that the resulting individual filters 8 to be cut from the grooved filter rod 26 will have one aperture 22 in each of its grooves 18.

With reference to FIGS. 5, 8 and 9, the groove forming reciprocating die 40 further includes filter rod stripper means 56 for holding the grooved filter rods 26 stationary as the lower and upper die blocks 42 and 44, respectively, move vertically away from each other so that the groove forming projections 48 and aperture forming punches 54 can be extracted from the filter rod 26 after the grooves 18A and apertures 22 have been formed therein. As can be best seen in FIGS. 5, 8 and 9, the filter rod stripper means 56 includes an elongated plate 58 transversely disposed to the path of movement of the filter rods 26 through the reciprocating die 40 and located between the two ranks "C" and "D" of groove forming projections 48 of the upper and lower die blocks. As can be best seen in FIG. 9, the stripper plate 58 is formed with a number of parallel through bores 60 corresponding to the number of filter rods 26 to be simultaneously fed through the apparatus 28. To this end, each through bore 60 is situated with its longitudinal axis coaxially disposed with the longitudinal centerline of a different one of aligned pairs 50 of groove forming projections 48 in the ranks "C" and "D" of the upper and lower die blocks of the die 40. The through bores 60 are somewhat larger in diameter than the diameter of a filter rod 26 so that the filter rod 26 will be coaxially, slidably received through the bores 60. The stripper plate 58 is affixed to the frame of the apparatus 28 so that it is held stationary as the lower and upper die blocks reciprocate.

Figure 6:
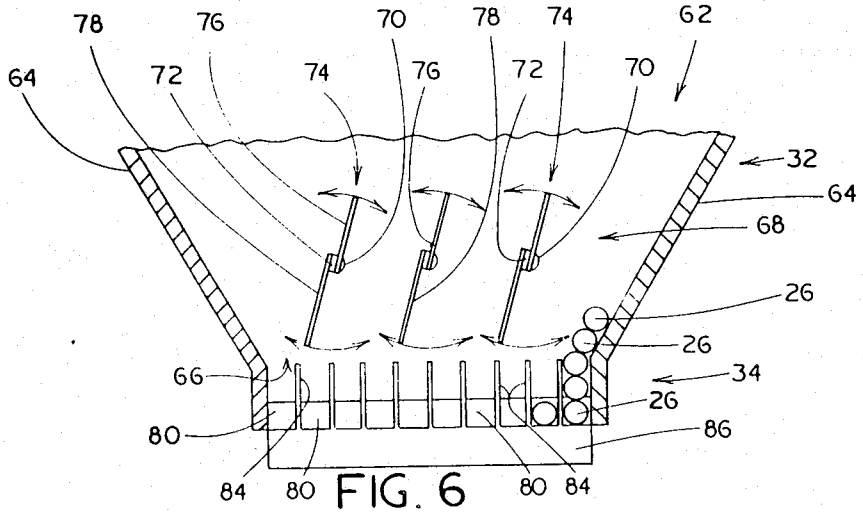
FIG. 6 is a view of one end of the apparatus of FIG. 5 as viewed in the direction of arrows 6—6 in FIG. 5.

The hopper means 32 and dispenser means 34 are best seen in FIGS. 5, 6 and 8. The hopper means 32 is shown as including a filter rod hopper housing 62 having side walls 64 which converge downwardly toward the dispenser means 34 defining an open bottom 66 at the dispenser means 34. The open bottom 66 of the hopper housing 62 is just wide enough to allow the concurrent, parallel passage therethrough of only that number of filter rods 26 corresponding to the number of parallel pairs 50 of groove forming projections 48 in the rank "C" of the lower groove forming die block 42. The hopper housing 62 also includes filter rod agitating means 68 located above the open bottom 66 to prevent the filter rods 26 from jamming as they descend to the open bottom 66. The agitating means 68 includes a plurality of reciprocating paddles 70 located at spaced apart intervals across the width of the hopper housing 62. Each reciprocating paddle 70 includes a reciprocating driving axle 72 with blade means 74 attached thereto for reciprocating movement therewith. The blade means 74 includes a relatively rigid blade portion 76 attached to the axle 72 extending generally upwardly therefrom in the hopper housing 62 away from the bottom opening 66, and a relatively flexible blade portion 78 attached to the axle 72 in general alignment with the rigid blade portion 76 extending generally downwardly therefrom in the hopper housing 62 toward the bottom opening 66. The relatively rigid blade portion 76 can be fabricated of, for example, stainless steel, and the relatively flexible blade portion 78 can be fabricated of, for example, nylon. As the filter rods 26 move downwardly in the hopper 62 under the influence of gravity toward the open hopper bottom 66, the blades 76 and 78 agitate the filter rods 26 so that they will not jam in the convergence of the hopper 62. The flexible blade portion 78 is located just above the open hopper bottom 66 of the hopper housing 62 whereat the space in which to agitate the filter rods 26 is minimum. As the flexible blade portion 78 reciprocates agitating the filter rods 26 just before the filter rods 26 pass through the open hopper bottom 66, the flexible blade portion 78 flexes so as not to crush the filter rods 26.

Figure 7:
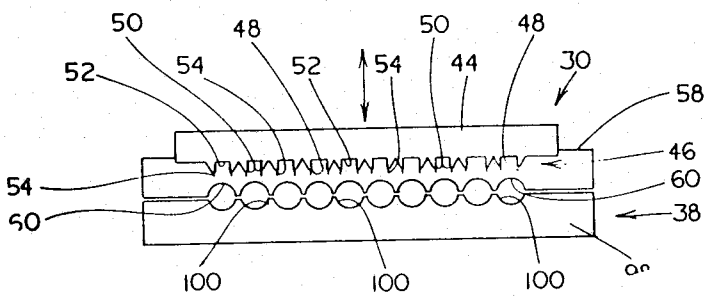
FIG. 7 is a view of the other end of the apparatus of FIG. 5 as viewed in the direction of arrows 7—7 in FIG. 5.

The filter rod dispenser means 34 is located below the open hopper bottom 66 to receive the filter rods 26 from the hopper housing 62. The dispenser means 34 includes a plurality of elongated, parallel filter rod guide ways 80, and filter rod pusher means 82 for moving the filter rods 26 along the guide ways 80 toward the reciprocating die 40. As can be best seen in FIGS. 6 and 8, the guide ways 80 are equal in number to the number of pairs 50 of groove forming projections 48 in the rank "C" of projections 48, with the longitudinal centerline of each guide way 8 in longitudinal alignment with the longitudinal centerline of a different one of the pairs 50 of groove forming projections 48 of the rank "C" in the die block 42. With particular reference to FIGS. 6 and 8, the guide ways 80 are defined between elongated, parallel, spaced apart fences 84 projecting upwardly from a horizontal dispenser plate 86. The filter rods 26 drop through the open hopper bottom 66 and are each longitudinally received in a different one of the elongated guide ways 80. With reference to FIGS. 5 and 7, the filter rod pusher means 82 includes a plurality of horizontally disposed, parallel fingers 88 longitudinally movable, in unison, into and out of the filter rod guide ways 80. The pusher fingers 88 are equal in number to the number of filter rod guide ways 80 with each pusher fingers 88 in longitudinal alignment with a different one of the elongated guide ways 80. As shown, the pusher fingers 88 are attached at one end to, and extend in a cantilever fashion from a mounting block 90 which can be attached to the operating piston rod of, for example, an hydraulic or pneumatic cylinder device 91 for selected movement toward and away from the filter rod guide ways 80 as indicated by the double headed arrow.

With reference to FIGS. 5 and 8, the filter rod feed guide means 36 is located between the guide ways 80 of the dispenser means 34 and the lower die block 42 of the reciprocating die 40 for transferring the ungrooved filter rods 26 in an aligned manner from the guide ways 80 to the groove forming die 40. As shown, the feed guide means 36 includes a horizontal plate 92 extending between the guide way 80 and lower die block 42. A plurality of elongated, parallel, spaced apart filter rod paths 94 are formed in the upper surface of the horizontal plate 92 such that each filter rod path 94 is in longitudinal alignment with and extends between different sets of the longitudinally aligned guide ways 80 of the dispensed means 34 and channels 52 between pairs 50 of groove forming projections 48 of the lower die block 42. As can be seen in FIG. 8, the feed guide means 36 further includes small air flow apertures 96 formed in each of the filter rod paths 94 which are in air flow communication with a vaccum pump (not shown) so that the filter rods 26 longitudinally moving in the filter rod paths 94 will be held in the paths 94 by suction created by the air flowing into the apertures 94.

Now with reference to FIGS. 5, 7 and 8, the filter rod exit guide means 38 is located downstream of the reciprocating die 40 for transferring grooved filter rod 26 away from the groove forming die 40. The exit guide means 38 is illustrated as being essentially identical to the filter rod feed guide means 36. The filter rod exit guide means 38 is shown as comprising a horizontal plates 98 extending downstream from the lower die block 42 from the opposite side of the die 40 from the filter rod feed guide means 36. The horizontal plate 98 is formed with a plurality of elongated, parallel, spaced apart filter rod paths 100 such that each filter rod path 100 is in longitudinal alignment with a different one of the channels 52 between pairs 50 of groove forming projections 48 of the lower die block 42. As can be seen in FIG. 8, the exit guide means 38 is also provided with air flow apertures 102 formed in each of the filter rod paths 100 which are in air flow communication with a vacuum pump (not shown) so that the grooved filter rods 26 are held in the filter rod paths 100 by suction created by the flow of air through the apertures 102.

Therefore, as can be best seen by reference to FIGS. 5 and 8, the longitudinally aligned guide ways 80 of the dispenser means 36, channels 52 defined between groove forming projections pairs 50 of the die 40, and filter rod paths 100 of the exit guide means 38 cooperates to provide smooth, continuous, straight paths through which the filter rods 26 are longitudinally moved as they progress through the apparatus 28.

FIG. 10 illustrates a drive system, generally denoted as the number 104, for reciprocally moving the lower die block 42 and upper die block 44, in unison, toward and away from each other. As shown, the drive system 104 comprises a compression spring 106 which bias the upper die block 44 in a vertical upward direction away from the lower die block 42, and a common fluid actuated cylinder, such as for example, pneumatic cylinder 108 which drives both the upper and lower die blocks toward each other. The drive system further includes a first pivotal cam 110 mounted to a first cam axle 112 for rotation therewith located below the lower die block 42, and a second pivotal cam 114 mounted to a second cam axle 116 for rotation therewith located above the upper die block 44. A first cam follower wheel 118 is rotatably mounted to the underside of the lower die block 42 in position to contact and follow the cam surface of the first pivotal cam 110, and a second cam follower wheel 120 is rotatably mounted to the top side of the upper die half 44 in position to contact and follow the cam surface of the second pivoted cam 114. A first crank arm 122 is attached to the first cam axle 112 for movement therewith, and a second crank arm 124 is attached to the second cam axle 116 for movement therewith. The free end 126 of the first crank arm 122 and the free end 128 of the second crank arm 124 are interconnected by a link 130. The operating rod 132 of the pneumatic cylinder 108 is pivotally connected at its end to the first pivoted cam 110 essentially to the first cam axle 112. As the pneumatic cylinder 108 is activated so as to extend the operating rod 132, due to the essentric mounting of the operating rod 132 to the first pivoted cam 110, the first pivotal cam 110 is caused to pivot about the first cam axle 112 in, for example, a clockwise direction as viewed in FIG. 10. The clockwise rotation of the first pivotal cam 110 in turn causes the first cam axle 112 and first crank arm 122 attached thereto to also rotate in a clockwise direction. The clockwise rotation of the first crank arm 122 pulls the interconnecting link 130 downwardly which causes the second crank arm 124 to rotate in a clockwise direction which causes in the second cam axle 116 and second pivotal cam 114 also rotating clockwise. The cam surfaces of the first pivotal cam 110 and second pivotal cam 114 are so configured that upon clockwise rotation they present the cam advance portion of their cam surfaces to the first and second cam follower wheels 118 and 120, respectively. As the cam follower wheels 118 and 120 follow the advance sections of the first and second cams 110 and 114, respectively, the cam follower wheels 118 and 120 are moved in a direction perpendicular to the axis of rotation of the first and second cams 110 and 114, thus, moving the lower die block 42 and upper block 44, in unison, toward each other.

As the pneumatic cylinder 108 is activated so as to retract the operating rod 132, the first and second pivot cams 110 and 114 are caused to rotate in the opposite direction, for example, counter-clockwise, which progressively retracts the advance portion of the cam surfaces of the first and second cams 110 and 114 from the first and second cam follower wheels 118 and 120, which allows the lower and upper die blocks to move in unison away from each other. The lower die block 42 moves vertically downwardly under the influence of gravity, and the upper die block 44 moves vertically upwardly under the influence of the compression springs 106.

In the overall operation of the apparatus 28, filter rods 26 to be grooved are stored in the hopper 62. As the filter rods to be grooved pass by gravity to the open bottom 66 of the hopper 62, the rigid blades 76 and flexible blades 78 of the blade means 74 reciprocate to agitate the filter rods so that the chances of them jamming together at the open bottom 66 of the hopper 62 is diminished. The filter rods 26 fall through the open bottom 66 in generally parallel relationship and are each received in longitudinal alignment in a different one of the guideways 80 of the dispenser means 34. The pusher means 82 is moved by the pneumatic cylinder toward the guideways 80 whereupon each of the fingers 88 longitudinally moves into a different one of the guideways 80 and, in so doing, the free-end of each finger 88 contacts an end of the filter rod 26 in that guideway 80 and pushes the filter rod 26 longitudinally of the guideway 80 of the dispenser means 34 and into the longitudinally aligned filter rod paths 100 of the feed guide means 36. The air flow through the air flow apertures 96 in each of the filter rod paths 94 holds the filter rods 26 in the filter rod paths 94 by suction while still allowing the filter rods to be moved longitudinally in the filter rod paths 94. As the filter rods 26 are moved longitudinally into the filter rod paths 94, the leading end of each moving filter rod contacts the trailing end of a filter rod previously moved into the filter rod path 94 and pushes that filter rod into the longitudinally aligned channels 52 defined between pairs 50 of groove forming projections 48 of the lower die block 42. When a filter rod 26 is pushed into proper position in the groove forming die 40, it projects through the through bores 60 of the filter rod stripper plate 58. The pneumatic cylinder 108 is activated and moves the lower and upper die blocks 42 and 44, respectively, toward each other so that the groove forming projections 48 embed in the filter rod 26 impressing the two ranks "C" and "D" of double length grooves 18A in the periphery of the filter rod 26 at selected intervals around the circumference of the filter rod 26. Concurrently, the aperture forming punches 54 penetrate through the wrapper material 12 of the rod 26 forming apertures 22 in the double length grooves 18A. The pneumatic cylinder 108 is activated to move the lower and upper die blocks 42 and 44 away from each other. As the die blocks 42 and 44 move away from the filter rod 26, the now grooved filter rods 26 are held stationary in the bores 60 of the stationary stripper plate 58, and the groove forming projections 48 and aperture forming punches 54 of the lower and upper die blocks 42 and 44 are extracted from the filter rod 26. After the lower and upper die blocks 42 and 44 have moved away from the filter rod 26, the pneumatic cylinder connected to the filter rod pusher means 82 is again activated to move ungrooved filter rods 26, which have been newly deposited from the hopper means 32 into the filter rod guideways 80, from the guideways 80 toward the reciprocating groove forming die 40. The leading end of the moving newly deposited filter rods 26 push against the trailing end of the next to be grooved filter rods 26 residing in the filter rod paths 94 of the feed guide means 36, thus, moving the next to be grooved filter rods 26 into the reciprocating groove forming die 40. As the next to be grooved filter rods 26 longitudinally enter the channels 50 of the die 40, their leading ends push against the trailing ends of the just grooved filter rods 26 in the die 40 moving the just grooved filter rods 26 out of the groove forming die 40 and longitudinally into the filter rod paths 100 of the exit guide means 38. The grooved filter rods 26 already in the filter rod paths 100 of the exit guide means 38 are pushed, by the just grooved rods 26, out of the exit guide means 38 and, therefore, out of the apparatus 28 for further processing into individual filters 8.

The foregoing detailed description is given primarily for clearness of understanding and no unnecessary limitations are to be understood thereby for modifications will become obvious to those skilled in the art upon reading this disclosure and may be made without departing from the spirit of the invention or scope of the appended claims.

What is claimed is:

1. An apparatus for making grooves in a filter rod comprising:

die means comprising a lower die block adapted for vertical movement and having groove forming means at its upwardly facing surface, an upper die block adapted for vertical movement and having groove forming means at its donwardly facing surface, the downwardly facing surface of the upper die block being disposed in overlaying facing relationship to the upwardly facing surface of the lower die block, the groove forming means of the lower die block and upper die block are adpated to be embedded into a filter rod disposed between the lower and upper die blocks to impress grooves in the filter rod when the lower and upper die blocks are vertically moved toward each other;

means for moving the lower and upper die blocks vertically toward each other in unison;

stripper means for holding the grooved filter rod stationary in the die means as the lower and upper die blocks move away from each other to allow the groove forming means of the lower and upper die blocks to be extracted from the filter rod;

hopper means for storing a plurality of filter rods to be grooved;

dispenser means for receiving ungrooved filter rods from the hopper means, orienting the filter rods for proper feeding of the ungrooved filter rods to the die means, and feeding the ungrooved filter rods to the die means;

feed guide means for transferring the ungrooved filter rods in an aligned manner from the dispenser means to the die means; and, exit guide means for transferring grooved filter rods away from the die means in an orderly manner to diminish the chances of a jam of grooved filter rods at the exit from the die means.

2. The groove making apparatus of claim 1, wherein the hopper means comprises:

a hopper housing having downwardly converging walls and means defining an open bottom; and, agitating means disposed in the hopper housing above the open bottom of the housing for agitating the filter rods within the hopper housing as the filter rods move downwardly toward the open bottom of the hopper housing.

3. The groove making apparatus of claim 2, wherein the agitating means comprises:

a plurality of reciprocating paddles located at spaced apart intervals across the width of the hopper housing.

4. The groove making apparatus of claim 3, wherein each reciprocating paddle comprises:

a relatively rigid blade portion extending generally upwardly away from the open bottom of the hopper housing, and a relatively flexible blade portion extending generally downwardly toward the open bottom of the hopper housing.

5. The groove making apparatus of claim 1, wherein the dispenser means comprises:

means defining a plurality of elongated, parallel filter rod guide ways in general longitudinal alignment with the groove forming projections of the lower die block, the guide way defining means being located beneath the hopper means; and, filter rod pusher means for moving filter rods along the guide ways toward the die means.

6. The groove making apparatus of claim 5, wherein the filter rod pusher means comprises:

a plurality of fingers equal in number of filter rod guide ways, each finger being in longitudinal alignment with a different one of the guide ways, the fingers being adapted for longitudinal movement, in unison, into and out of the guide ways; and, means for moving the fingers into and out of the guide ways.

7. The groove making apparatus of claim 1, wherein the feed guide means comprises:

means defining a plurality of elongated, parallel filter rod paths equal in number to the number of guide ways, each filter rod path neing in longitudinal alignment with a different one of the filter rod guide ways, and the filter rod path defining means being located between the dispenser means and die means.

8. The groove making apparatus of claim 7, wherein the feed guide means further comprises:

means for holding the filter rods in the filter rod paths while allowing longitudinal movement of the filter rods along the filter rod paths.

9. The groove making apparatus of claim 8, wherein the filter rod holding means comprises:

pneumatic means for holding the filter rods in the filter rod paths by suction.

10. The groove making apparatus of claim 1, wherein the exit guide means comprises:

means defining a plurality of elongated, parallel filter rod paths in general longitudinal alignment with the groove forming projections of the lower die block, the filter rod path defining means being located downstream of the die means.

11. The groove making apparatus of claim 10, wherein the exit guide means further comprises:

means for holding the filter rods in the filter rod paths while allowing longitudinal movement of the filter rods along the filter rod paths.

12. The groove making apparatus of claim 11, wherein the filter rod holding means comprises:

pneumatic means for holding the filter rods in the filter rod paths by suction.

* * * * *